US005360053A

United States Patent [19]

Kawa et al.

[11] Patent Number: 5,360,053

[45] Date of Patent: Nov. 1, 1994

[54] CONTINUOUS CASTING MOLD FOR STEEL

[75] Inventors: Franciszek Kawa, Adliswil; Adrian Stilli, Bülach, both of Switzerland

[73] Assignee: Concast Standard AG, Zürich, Switzerland

[21] Appl. No.: 831,681

[22] Filed: Feb. 5, 1992

[30] Foreign Application Priority Data

Feb. 6, 1991 [CH] Switzerland ..... 00367/91
Nov. 8, 1991 [CH] Switzerland ..... 03263/91

[51] Int. Cl.[5] ..... B22D 11/04
[52] U.S. Cl. ..... 164/418; 164/459
[58] Field of Search ..... 164/418, 459

[56] References Cited

U.S. PATENT DOCUMENTS 3,910,342 10/1975 Johnson ..... 164/459 X
4,207,941 6/1980 Shrum .
4,635,702 1/1987 Kolakowski et al. ..... 164/418
4,694,880 9/1987 Gladwin ..... 164/459
4,716,955 1/1988 Fastert ..... 164/418 X
4,834,167 5/1989 Streubel ..... 164/418
4,909,305 3/1990 Fasano ..... 164/418 X
4,955,428 9/1990 Schrewe ..... 164/418 X

FOREIGN PATENT DOCUMENTS 379093 11/1985 Austria .
0179364 4/1986 European Pat. Off. ..... 164/459
50-27027 9/1975 Japan ..... 164/418
64-75146 3/1989 Japan ..... 164/418

*Primary Examiner*—J. Reed Batten, Jr.
*Attorney, Agent, or Firm*—Darby & Darby

[57] ABSTRACT

A mold for the continuous casting of steel defines a casting passage having an inlet end for molten steel, an outlet end for a continuously cast steel strand, an upstream portion extending from the inlet end approximately halfway towards the outlet end, and a downstream portion extending from the upstream portion to the outlet end. The upstream portion is formed with a plurality of radially outwardly directed protuberances which are arranged side-by-side circumferentially of the casting passage. The size of the protuberances decreases from the inlet end towards the outlet end in such a manner that the strand is shaped during travel through the upstream portion of the casting passage.

19 Claims, 3 Drawing Sheets

Fig. 4
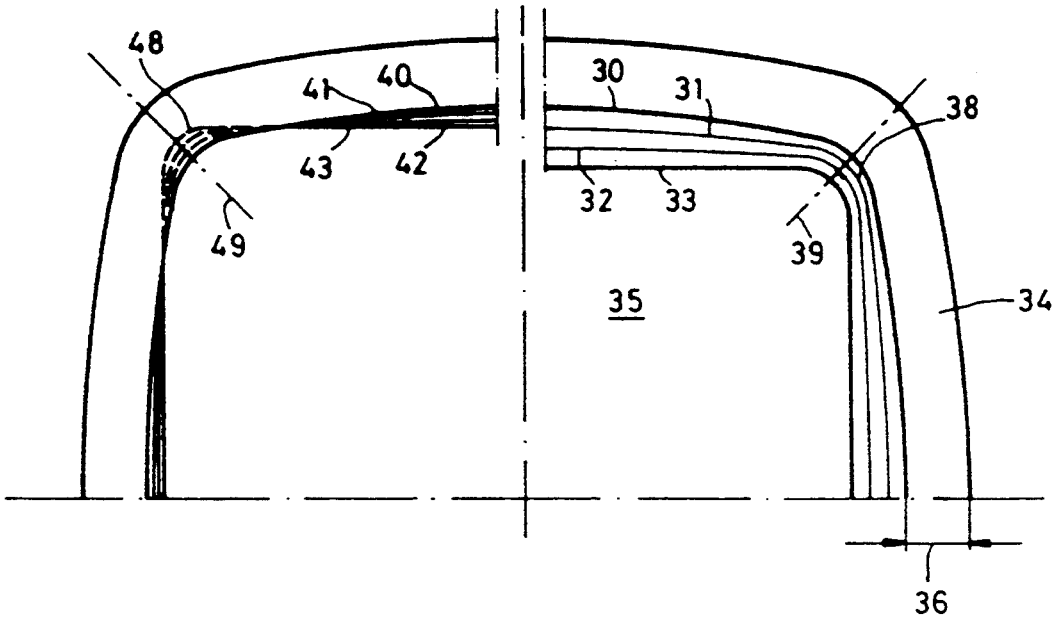
Fig. 3
Fig. 5
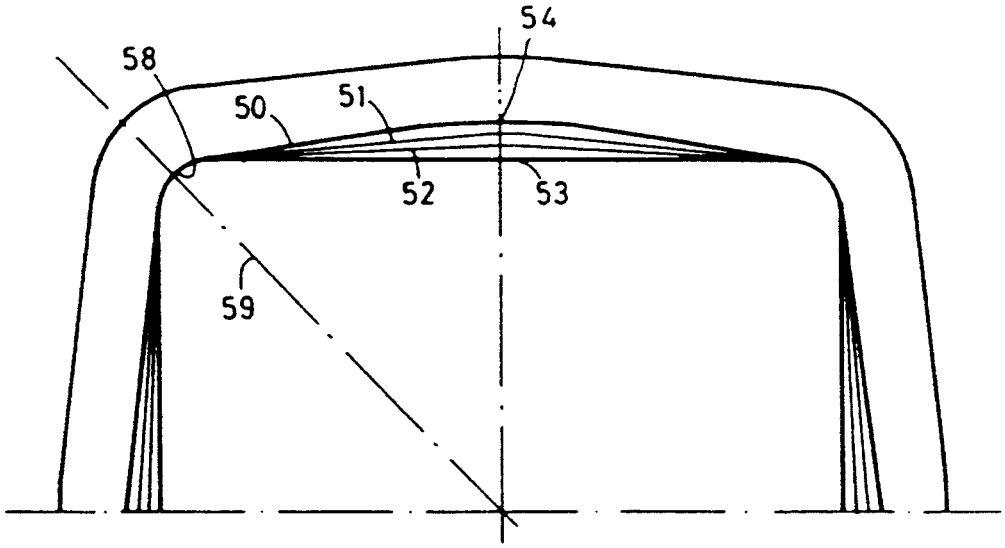

CONTINUOUS CASTING MOLD FOR STEEL

BACKGROUND OF THE INVENTION

The invention relates generally to continuous casting. More particularly, the invention relates to a mold for the continuous casting of metals, especially steel, and a method of making the mold.

Since the inception of continuous casting using through molds, the art has been concerned with the problem of air gap formation below the meniscus and between the strand shell and mold wall. Air gap formation substantially reduces the heat transfer between the mold and the strand shell and causes non-uniform cooling of the strand shell. This leads to defects in the strand such as rhomboidity, cracks, microstructural faults, etc. Many proposals have been made to achieve the best possible contact on all sides between the strand shell and the mold wall along the entire length of the mold, and hence the optimum conditions for heat removal. These include walking beams, injection of coolant into the air gap, mold cavities with varying tapers, and so on.

A mold for the continuous casting of steel strands having polygonal and, in particular, square cross sections is known from U.S. Pat. No. 4,207,941. The mold cavity, which is open at two ends, has a square cross section with corner concavities at the molten steel inlet end and an irregular dodecagonal cross section at the strand outlet end. The taper in the casting direction increases progressively towards the corners in the corner regions and, along part of the length of the mold, is approximately twice as large in the area of a concavity as in the central zone of the mold wall. When casting with such molds, the strand can become wedged in the mold thereby leading to cracking of the strand and breakouts. Moreover, a dodecagon is cast rather than a square. It is particularly difficult to dimension molds of this type so that the casting speed can be varied during a running casting operation as is required with long sequence casts having many ladle changes.

SUMMARY OF THE INVENTION

It is an object of the invention to provide a continuous casting mold which enables improved cooling of a strand to be obtained.

Another object of the invention is to provide a continuous casting mold which allows controlled cooling of substantially the entire circumference of a strand to be achieved.

An additional object of the invention is to provide a continuous casting mold which permits strand quality to be improved.

A further object of the invention is to provide a continuous casting mold which makes it possible to increase the casting speed.

It is also an object of the invention to provide a continuous casting mold which enables the casting speed to be changed during a casting procedure without substantial cracking of the strand and without breakouts.

Yet another object of the invention is to provide a method of making a continuous casting mold capable of controllably cooling substantially the entire circumference of a strand.

One more object of the invention is to provide a method of making a continuous casting mold capable of producing strands of better quality.

Still a further object of the invention is to provide a method of making a continuous casting mold capable of being used at higher casting speeds.

An additional object of the invention is to provide a method of making a continuous casting mold capable of preventing substantial cracking of the strand, as well as breakouts, even when the casting speed is changed during a casting procedure.

The preceding objects, and others which will become apparent as the description proceeds, are achieved by the invention.

One aspect of the invention resides in a mold for the continuous casting of metals, particularly steel. The mold comprises wall means defining a casting passage having a periphery, a longitudinal axis, an open inlet end for molten metal and an open outlet end for a continuously cast strand of the metal. The inlet and outlet ends are spaced from one another axially of the casting passage. The casting passage includes an axially extending portion in which its periphery comprises a plurality of sections circumferentially of the casting passage. Each of the sections defines a protuberance which decreases in size in a direction from the inlet end towards the outlet end such that the strand is shaped during travel through the axially extending portion of the casting passage.

For billets and small blooms, the mold of the invention makes it possible to produce a circumferentially uniform cooling effect whose intensity can be controlled within predetermined limits. This allows crystallization of the strand shell to be influenced and strand quality to be improved. Diamond-shaped edges, as well as surface and microstructural defects, can be avoided. Due to the controlled deformation of the strand, uniformity of cooling along the circumference of the strand can be improved even when the casting speed is changed. The danger of strand cracking or breakouts at high casting speeds can be substantially reduced.

In one embodiment of the mold of the invention, the protuberances of the respective circumferential sections constitute arcs. Such arcs have greater configurational stability, particularly in the highly thermally stressed region of the meniscus, than conventional molds. On the one hand, this greater configurational stability improves the dimensional stability of the casting passage during the life of a tube mold or other mold. On the other hand, strand quality is improved.

As a rule, the size of a protuberance is reduced along the casting passage from the region of the meniscus. This reduction in size can take place over part of the length of the mold or over the entire length thereof. In one exemplary embodiment of the mold, each circumferential section has a residual bulge or protrusion at the mold outlet.

According to another embodiment of the invention, the casting passage has corners at the mold outlet, and neighboring corners are connected by flat sides, i.e., the casting passage is polygonal and all sides thereof are planar. For instance, the casting passage may have a quadrangular or hexagonal cross section. Examples of a quadrangular cross section are a square and a rectangle.

The casting passage can also be circular at the outlet end of the mold. It is further possible for the outlet end of the casting passage to constitute a preform, e.g., to resemble an I-beam.

When dimensioning the protuberances, care should be exercised to prevent wedging of the strand at the boundary, e.g., at a corner, between two abutting circumferential sections or protuberances even when the dwell time of the strand in the mold is short, that is, even at high casting speeds. To this end, the difference between the arc length at the meniscus and the arc length at the mold outlet, or the difference between the arc length at the meniscus and the chord length at the mold outlet, is determined and compared with the shrinkage of the strand transverse to the casting direction. By choosing the size of a protuberance appropriately, this difference can be selected so that it essentially corresponds to the strand shrinkage.

The protuberances may be arranged in diametrically opposed pairs. When the shaping portion of the mold or casting passage, that is, the portion with the protuberances of decreasing size, includes the mold inlet, the width of the casting passage at the inlet as measured in the region of maximum bulge, i.e., as measured between the radially outermost locations of opposed protuberances, may be approximately 5 to 15 percent greater than the corresponding width of the casting passage at the mold outlet. The corresponding width of the casting passage at the mold outlet is the width as measured between two peripheral locations of the casting passage which are respectively in axial alignment with the diametrically opposed, radially outermost locations used to determine the width at the mold inlet. Preferably, the width at the mold inlet is at least 8 percent greater than the width at the mold outlet.

The size of a protuberance can decrease degressively or progressively along the mold in the casting direction and can tend towards zero. Advantageously, the size of a protuberance decreases continuously in the casting direction.

A taper can be employed to change the size of a protuberance in the casting direction, i.e., the circumferential sections or protuberances can taper axially of the casting passage in the casting direction. The taper of a circumferential section or protuberance may change circumferentially thereof. By way of example, the taper of a circumferential section or protuberance at the circumferential end portions of the same may be between 0 and 1 percent per meter while the taper at a central portion of the circumferential section or protuberance may be between 10 and 35 percent per meter. The shapes and sizes of all protuberances may be the same.

As indicated earlier, the decrease in size of the protuberances may take place over the entire length of the casting passage or over only part of the length of the casting passage. Advantageously, the decrease in size of the protuberances takes place over at least 50 percent of the length of the casting passage. For a mold length of 800 mm as in conventional molds, the decrease in protuberance size would then occur over a distance of at least 400 mm.

In the rectangular, conical molds of the prior art, the taper in the corners or corner regions is greater than that at the side walls by a factor of the square root of 2. For molds having a taper which exceeds the conventional values of 0.9 to 1.2 percent per meter, this can lead to wedging of the strand and strand cracking. In contrast to the effect of the conically disposed walls found in the molds of the prior art, the invention provides for the strand to be shaped, and hence for cooling to be regulated, during travel of the strand through the shaping portion of the casting passage. At the boundary between two abutting circumferential sections or protuberances, or in the corners of the casting passage, the taper can be freely selected independently of the size and taper of the protuberances. For the first time, it is possible to construct molds where the taper in the corners or corner regions is independent of the taper and shape of the outwardly bowed side walls. For instance, the taper in the corners can be positive, neutral or negative depending upon the degree to which the protuberances formed in the strand are reshaped, the shrinkage of the strand, etc.

When the casting passage has a diagonal plane, the shaping portion of the casting passage may have a taper, as measured in such plane, of 0 to 1 percent per meter. Preferably, the taper in the diagonal plane is between 0.1 and 0.5 percent per meter.

The corners of polygonal casting passages are rounded for various reasons known in the art. It has been found particularly advantageous for the corners of a polygonal casting passage in the mold of the invention to constitute concavities having a radius which equals 3 to 8 percent of the distance between neighboring corners, i.e., 3 to 8 percent of the length of a side as measured in a plane normal to the casting direction.

The outwardly bowed walls of the mold of the invention can have a variety of geometric shapes. However, to simplify the production of mold tubes or mold walls in accordance with the invention, it is preferred for the protuberances to be bounded by curved surfaces and/or flat surfaces.

In one embodiment of the mold, the protuberances are bounded by part-circular surfaces having radii which increase towards infinity in the casting direction. The periphery of the casting passage here preferably comprises 2 to 6 sections circumferentially of the casting passage with each circumferential section defining a substantially part-circular protuberance.

When the casting passage has rounded corners, the protuberances may merge tangentially into the concavities defined by the corners regardless of the geometric form of the protuberances.

The casting passage may include an axially extending first portion in which its periphery comprises a plurality of first sections circumferentially of the casting passage, and an axially extending second portion in which its periphery comprises a plurality of second sections circumferentially of the casting passage. Each of the circumferential sections again defines a protuberance which decreases in size in a direction from the mold inlet towards the mold outlet such that the strand is shaped during travel through the two portions of the casting passage. In this embodiment of the mold, the first sections are circumferentially offset with respect to the second sections. The various circumferential sections may have a predetermined circumferential length, and the first sections are then circumferentially offset with respect to the second sections by one-half of such predetermined circumferential length.

Another aspect of the invention resides in a method of making a mold for the continuous casting of metals, particularly steel. The production of a mold having protuberances which decrease in size in the casting direction can be effected by hot or cold deformation of copper-containing mold walls. It is of particular advantage for at least part of the casting passage, as considered axially of the latter, to be formed using an explosion forming technique. Tube molds of high precision with straight or curved longitudinal axes can be produced by forceful insertion of a mandrel with protuberances into a tube and subsequent explosion forming.

One embodiment of the method of the invention comprises the steps of forming a protuberance, by means of an expanding mandrel, in an internal peripheral surface of a tube made of a hardenable copper alloy; and dispersion hardening the tube or cold working the latter by shot peening.

The method may further comprise the step of bending the tube to a predetermined casting radius using a curved mandrel. The bending step is preferably performed prior to the forming step.

The method may additionally comprise the step of calibrating at least a portion of the tube by explosion forming.

The forming step may include forming two protuberances in such a manner that the protuberances abut along an axially extending zone of the internal peripheral surface of the tube. This zone can taper in axial direction of the tube, and the taper of the zone may then be derived from an internal circumferential length of the tube and the calculated shrinkage of a continuously cast strand to be produced in the tube.

The tube has an inlet end for molten metal and an outlet end for a continuously cast strand of the metal, and these ends are spaced from one another axially of the tube. The forming step may further include causing the protuberance to decrease in size along an axially extending portion of the tube, and in a direction from the inlet end towards the outlet end, such that the strand is shaped during travel through the axially extending portion of the tube.

The novel features which are considered as characteristic of the invention are set forth in particular in the appended claims. The construction and mode of operation of the improved mold, as well as the method of making the same, will, however, be best understood upon perusal of the following detailed description of certain specific embodiments when read in conjunction with the accompanying drawings.

BRIEF DESCRIPTION OF THE DRAWINGS

FIG. 3 is a fragmentary plan view, with four contour lines, of another embodiment of a mold in accordance with the invention;

FIG. 4 is a fragmentary plan view, again with four contour lines, of a further embodiment of a mold according to the invention;

FIG. 5 is a fragmentary plan view, once more with four contour lines, of an additional embodiment of a mold in accordance with the invention;

DESCRIPTION OF THE PREFERRED EMBODIMENTS

Figure 1:
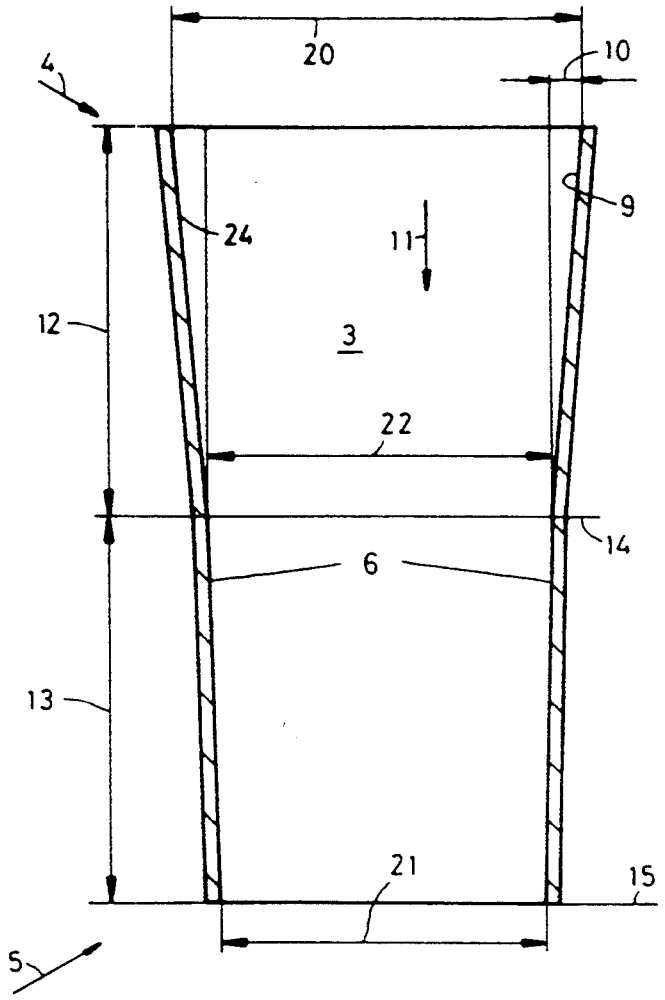
FIG. 1 is a longitudinal sectional view of one embodiment of a mold according to the invention as seen in the direction of the arrows I—I of FIG. 2.
Figure 2:
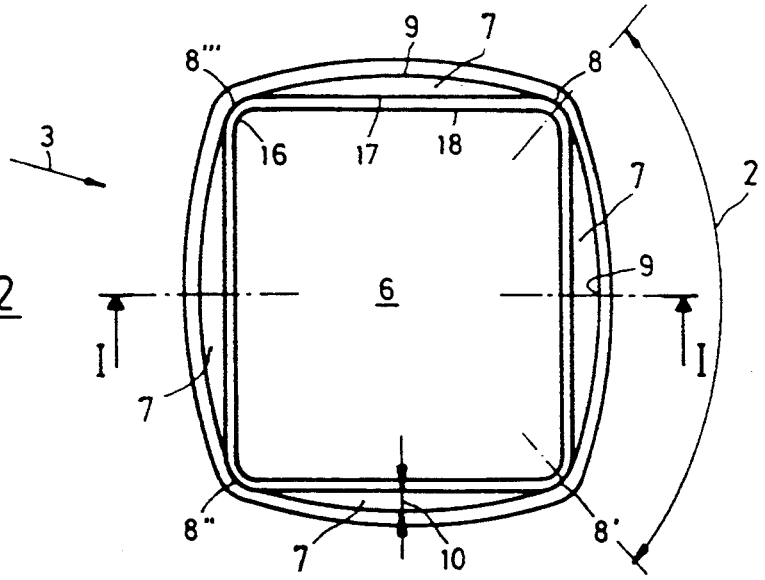
FIG. 2 is a plan view of the mold of FIG. 1.

FIGS. 1 and 2 illustrate a tube mold 3 for the continuous casting of strands having a polygonal cross section which is here assumed to be square. The mold 3 defines a mold cavity or casting passage 6 having an open inlet end 4 for molten metal, e.g., molten steel, and an open outlet end 5 for a continuously cast strand of the metal. The mold 3 and its mold cavity 6 are elongated and have a longitudinal axis, and the inlet end 4 and outlet end 5 of the mold cavity 6 are spaced from one another along such axis. A strand formed in the mold 3 is drawn through the casting passage 6 axially of the latter in the casting direction indicated by the arrow 11.

The cross section of the mold cavity 6 at the inlet end 4 has a different shape than the cross section of the mold cavity 6 at the outlet end 5. As best seen in FIG. 2, the mold cavity 6 has four corners 8, 8', 8'' and 8''' and the wall of the mold 3, which defines the periphery of the mold cavity 6, is made up of four sections 2 as considered circumferentially of the mold cavity 6. One of the circumferential sections 2 extends between the corners 8 and 8'; a second of the circumferential sections 2 extends between the corners 8' and 8''; a third of the circumferential sections 2 extends between the corners 8'' and 8'''; and the last of the circumferential sections 2 extends between the corners 8''' and 8. Each of the circumferential sections 2 of the mold wall is provided with a radially outwardly directed protuberance or bulge 9 which is here in the form of an arc. The protuberances 9 are formed in an upstream shaping portion 12 of the mold 3 extending axially from the inlet end 4 to a plane 14 located approximately midway between the inlet end 4 and the outlet end 5. The protuberances 9 have an arc height 10 which decreases continuously along the upstream portion 12 in the casting direction 11. The arc height 10, which represents the sizes of the protuberances 9, decreases in such a manner along the upstream portion 12 that a continuously cast strand formed in the mold 3 is shaped as it travels through the upstream portion 12.

The mold 3 has a downstream portion 13 which extends from the plane 14 to a plane 15 at the outlet end 5 of the mold 3. The downstream portion 13 has a square cross section and the corners 8–8''' thereof have concavities 16, i.e., are rounded, as in conventional molds.

The cross section of the mold cavity 6 in the plane 14 is shown by a circumferentially extending line 17 while the cross section of the mold cavity 6 in the plane 15 is indicated by a circumferentially extending line 18. At the outlet end 5 of the mold 3, the four sides of the mold cavity 6 between the four pairs of corners 8 and 8', 8' and 8'', 8'' and 8''', and 8''' and 8 are straight.

The basic cross-sectional configuration of the mold cavity 6 is square, and each side of the mold cavity 6 corresponds to one of the circumferential sections 2 so that, as mentioned previously, there are four circumferential sections 2 along the periphery of the mold cavity 6. The protuberances 9 may be considered to constitute enlargements of the cross section of the mold cavity 6 and the areas added to the cross section of the mold cavity 6 by the protuberances 9 are indicated at 7. In the illustrated mold 3, the four protuberances 9, as well as the four added areas 7, have the same shape and size.

The mold cavity 6 may have an hexagonal, rectangular, etc. basic cross-sectional configuration instead of the square basic cross-sectional configuration shown.

The protuberances 9 are arranged in diametrically opposed pairs and the reference numeral 20 identifies the maximum width of the mold cavity 6, i.e., the maximum internal width of the mold 3, at the inlet end 4. The maximum width 20 is the width of the mold cavity 6 as measured between the two radially outermost locations of the mold cavity 6 at two diametrically opposed protuberances 9. The reference numeral 21 indicates the width of the mold cavity 6 at the outlet end 5 of the mold 3, that is, the distance between two opposite sides of the mold 3 at the outlet end 5. The width 21 is measured between two peripheral locations of the mold cavity 6 which are respectively in alignment, as considered axially of the mold cavity 6, with the radially outermost locations of the mold cavity 6 used in determining the maximum inlet width 20. The maximum inlet width 20 is 5 to 15 percent greater, and preferably at least 8 percent greater, than the outlet width 21. Stated differently, the maximum inlet width 20 is 5 to 15 percent greater, and preferably at least 8 percent greater, than the width 22 of the mold cavity 6 as measured in the plane 14 at the end of the upstream portion 12 of the mold 3.

As stated earlier, the arc height 10 of the protuberances 9, which represents the maximum arc height of the latter decreases continuously in the casting direction 11, i.e., the protuberances 9 taper radially inwardly in the casting direction 11. The taper of a protuberance 9 along a line 24 passing through the radially outermost locations thereof, i.e., along a line down the center of the protuberance 9, can be calculated from the following equation:

$$T=[(Bo-Bu)/(Bu\times L)]\times 100$$

Here, Bo is the width at the top in millimeters, Bu the width at the bottom in millimeters L the relevant length in meters and T the taper in percent per meter. When calculated according to this equation the taper of a protuberance 9 can range from 10 to 35 percent per meter.

As indicated previously, the upstream portion 12 of the mold 3 can have a length equal to about 50 percent of the overall length of the mold 3. Thus, if the mold 3 is assumed to have a length of approximately 800 mm, the upstream portion 12 can have a length of 400 mm.

FIG. 3 is a fragmentary plan view of a corner region in another embodiment of a continuous casting mold according to the invention. The mold of FIG. 3, which is again a tube mold, is identified by the reference numeral 34 and includes a wall having a wall thickness 36. The mold 34 defines a mold cavity 35, and the illustrated corner 38 of the mold cavity 35 is formed with a concavity, i.e., the illustrated corner of the mold cavity 35 is rounded.

The mold 34 and mold cavity 35 are provided with arcuate protuberances which, as before, decrease in size and taper radially inwardly in the casting direction. The protuberances are illustrated by means of three contour lines 30, 31 and 32. A fourth contour line 33 shows the outline of the mold 34 at the outlet end of the latter.

The contour line 30 represents the uppermost edge of the mold cavity 35 of the mold 34, that is, the contour line 30 shows the outline of the mold 34 at the inlet end thereof. The contour lines 31 and 32 illustrate the decreasing arc height of the protuberances which shape a strand during casting. The taper of the protuberances at two levels between the mold inlet and mold outlet, i.e., between the contour lines 30 and 33, can be observed with the aid of the intermediate contour lines 31 and 32.

The mold 34 has a diagonal plane 39 which cuts the corner 38. The mold cavity 35 has a taper, as measured in the diagonal plane 39, of 0 to 1 percent per meter at the corner 38. This taper is preferably between 0.1 and 0.5 percent per meter. As a rule, the strand is not shaped in the diagonal plane 39.

FIG. 4 is similar to FIG. 3 but illustrates a further embodiment of a continuous casting mold in accordance with the invention. The mold cavity in the mold of FIG. 4 again has a corner which is formed with a concavity. The corner, which is identified by the reference numeral 48, is intersected by a diagonal plane 49 of the mold of FIG. 4.

FIG. 4 shows four contour lines 40, 41, 42 and 43 which respectively correspond to, and have the same significance as, the contour lines 30, 31, 32 and 33 of FIG. 3.

The main difference between the mold of FIG. 3 and that of FIG. 4 lies in the configuration of the corner 48 in the diagonal plane 49. Thus, the corner 48 has a negative taper in the casting direction. In the region of the corner 48, the mold cavity accordingly expands in the casting direction. Depending upon the format of the strand and the selected arc height of the protuberances which are formed in the strand and must be reshaped, it may be desirable to have a negative taper at the corner 48 in the diagonal plane 49 so as to eliminate any wedging of the strand in the mold. Moreover, by appropriate geometric design of the corner 48, cooling of the strand in the region of its corresponding edge can be controlled. A negative taper in the diagonal plane 49 can also be desirable to offset increases in chord length which occur when large protuberances formed in the strand are reshaped and are not compensated for by shrinkage.

FIG. 5 is similar to FIGS. 3 and 4 but illustrates an additional embodiment of a continuous casting mold according to the invention. In FIG. 5, two corners of the mold cavity are shown and both corners are formed with concavities. The corners are identified by the reference numeral 58, and one of the corners 58 is cut by a diagonal plane 59 of the mold of FIG. 5.

FIG. 5 shows four contour lines 50, 51, 52 and 53 which respectively correspond to, and have the same significance as, the contour lines 30, 31, 32 and 33 of FIG. 3, as well as the contour lines 40, 41, 42 and 43 of FIG. 4.

In contrast to FIGS. 1–4 where the protuberances are bounded by curved surfaces, FIG. 5 illustrates a protuberance which is bounded by flat surface portions intersecting in a plane 54. The protuberance is formed in an outwardly bowed side of the mold of FIG. 5 and, in order to prevent the formation of an edge in the middle of this outwardly bowed side, i.e., in the middle of the protuberance, such side is rounded in the region of the plane 54. The flat surface portions bounding the protuberance merge tangentially into the concavities of the corners 58. As before, the size of the protuberance decreases steadily in the casting direction as indicated by the contour lines 50–53.

The corners 58 in the mold of FIG. 5 are not tapered in the casting direction. As seen in diagonal planes such as the plane 59, the corners 58 extend substantially parallel to the longitudinal axis of the mold.

Calculations and/or casting experiments are necessary to determine the taper of the corners 38 and 48 in FIGS. 3 and 4. As the arc height of a protuberance decreases along the upstream shaping portion of a mold, the length of the chord associated with the arc or protuberance increases. The shrinkage of a strand transverse to the casting direction at a predetermined casting speed can be calculated and compared with the increase in chord length. The taper in a corner region can then be determined from the difference between these two values. When calculating the taper for a corner, it is necessary to take into account that the shrinkage of a strand at high casting speeds, i.e., the shrinkage of a strand when the dwell time of the strand in the mold is short, is less than that at lower casting speeds.

Figure 6:
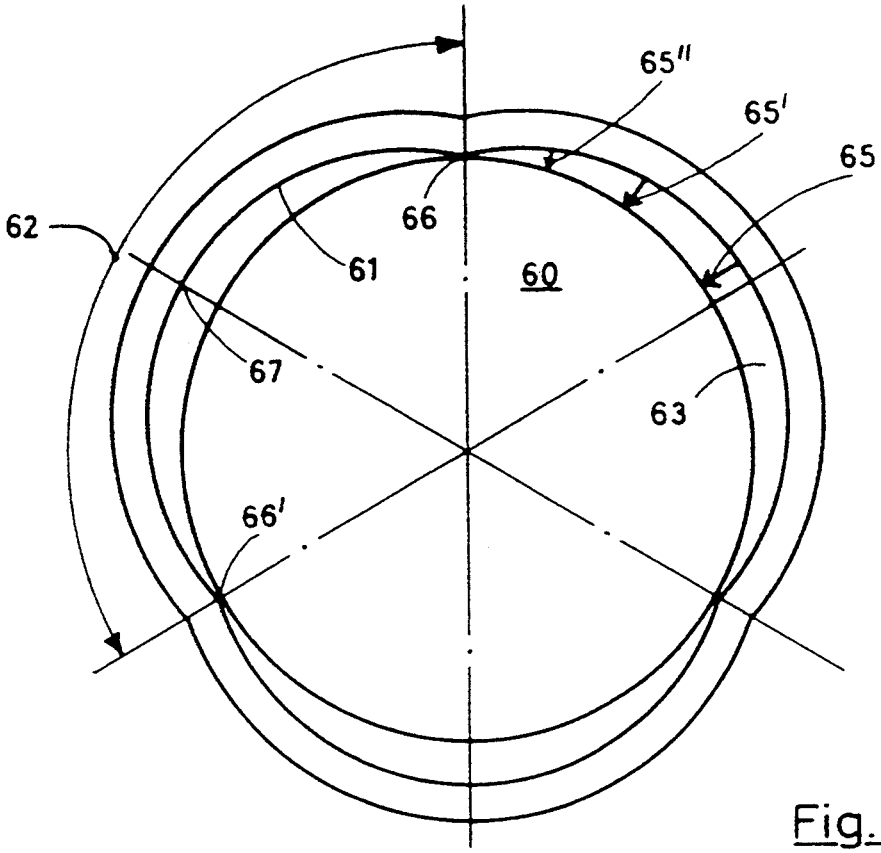
FIG. 6 is a plan view of yet another embodiment of a mold according to the invention.

FIG. 6 is a plan view of yet another embodiment of a continuous casting mold in accordance with the invention. In contrast to FIGS. 1–5 where the basic cross section of the mold is polygonal, the basic cross section of the mold of FIG. 6 is circular or approximately so.

The mold of FIG. 6 has a mold cavity 60 which is bounded by arc-shaped and circular surfaces. The wall 61 of the mold, which defines the periphery of the mold cavity 60, is made up of three sections 62 as considered circumferentially of the mold cavity 60. Each of the circumferential sections 62 of the mold wall 61 is provided with a radially outwardly directed protuberance 63 which here, again, is in the form of an arc. The protuberances 63, which are formed in an upstream shaping portion of the mold, may be considered to constitute enlargements of the cross section of the mold cavity 60. The degree of enlargement is indicated by arrows 65, 65′ and 65″ whose lengths represent the sizes of the protuberances 63. The size of each protuberances 63, as considered in the direction of the arrows 65, 65′ and 65″, decreases along the upstream portion of the mold in the casting direction such that a continuously cast strand formed in the mold is shaped as it travels through the upstream portion thereof.

The protuberances 63 in all three circumferential sections 62 of the mold have the same shape and size.

Each of the protuberances 63 has a pair of circumferential end portions 66 and 66′ as well as a central portion 67 intermediate the end portions 66,66′. The protuberances 63 are tapered in the casting direction, and the taper of a protuberance 63 changes circumferentially thereof. Thus, the taper of a protuberance 63 at the end portions 66,66′ is between 0 and 1 percent per meter while, as a rule, the taper of a protuberance 63 at the central portion 67 is in the range of 10 to 35 percent per meter.

Figure 7:
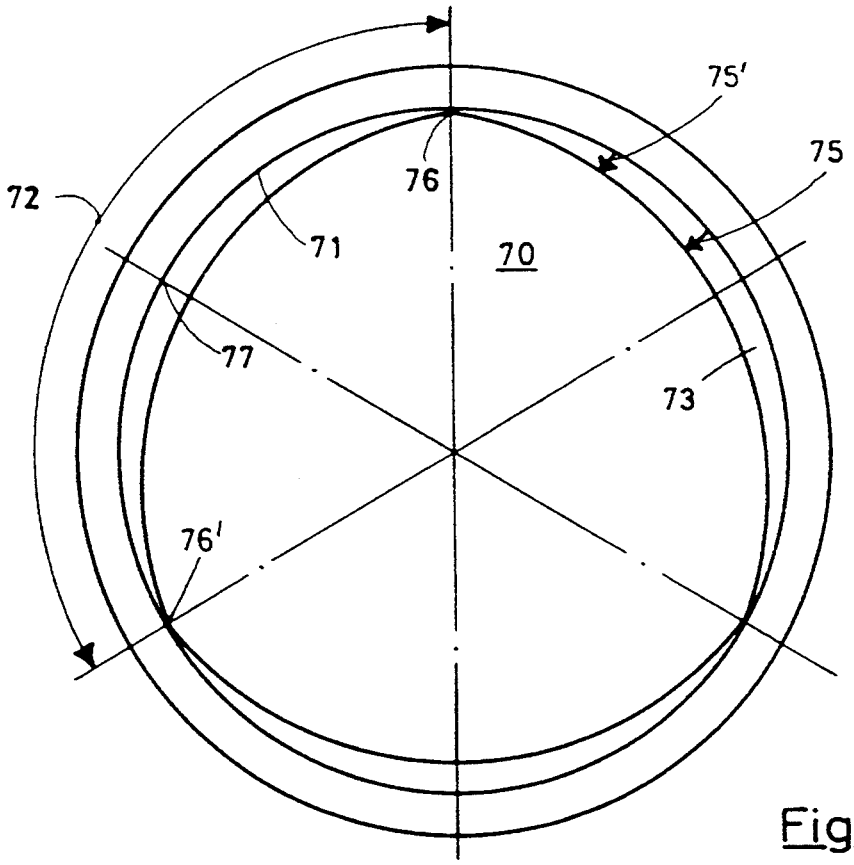
FIG. 7 is a plan view of still a further embodiment of a mold in accordance with the invention.

FIG. 7 is similar to FIG. 6 but illustrates still a further embodiment of a continuous casting mold according to the invention. As in FIG. 6, the basic cross section of the mold shown in FIG. 7 is circular or approximately so.

The mold of FIG. 7 has a mold cavity 70 which, as before, is bounded by arc-shaped and circular surfaces. The wall 71 of the mold, which defines the periphery of the mold cavity 70, is made up of three sections 72 as considered circumferentially of the mold cavity 70. Each of the circumferential sections 72 of the mold wall 71 is provided with a radially outwardly directed protuberance 73 in the form of a part-circular arc. The protuberances 73, which are formed in an upstream shaping portion of the mold, may be considered to constitute enlargements of the cross section of the mold cavity 70. The degree of enlargement is indicated by arrows 75 and 75′ whose lengths represent the sizes of the protuberances 73. The size of each protuberances 73, as considered in the direction of the arrows 75 and 75′, decreases along the upstream portion of the mold in the casting direction such that a continuously cast strand formed in the mold is shaped as it travels through the upstream portion thereof.

The protuberances 73 in all three circumferential sections 72 of the mold have the same shape and size.

Each of the protuberances 73 has a pair of circumferential end portions 76 and 76′ as well as a central portion 77 intermediate the end portions 76,76′. The protuberances 73 are tapered in the casting direction, and the taper of a protuberance 73 changes circumferentially thereof. Thus, the taper of a protuberance 73 at the end portions 76,76′ is between 0 and 1 percent per meter while, as a rule, the taper of a protuberance 73 at the central portion 77 is in the range of 10 to 35 percent per meter.

Although the mold of FIG. 6 is shown as being divided into three circumferential sections 62 and the mold of FIG. 7 is likewise shown as being divided into three circumferential sections 72, the number of circumferential sections can be selected at will. However, as a rule, the number of circumferential sections for a generally circular mold such as those illustrated in FIGS. 6 and 7 will be from 2 to 6.

In molds having mold cavities of generally circular cross section, it is possible to shape a strand along two axial shaping portions of the mold. These shaping portions can be axially adjacent to one another or can be separated in axial direction of the mold by an intermediate zone of the mold. When a mold is provided with two shaping portions, the circumferential sections making up one of the shaping portions can be offset with respect to the circumferential sections making up the other of the shaping portions. The circumferential sections can have a predetermined circumferential length and it is preferred for the circumferential sections of the respective shaping portions to be offset relative to one another by one-half of such predetermined circumferential length.

All of the techniques, such as lubrication, surface treatment, coatings, appropriate selection of mold material, etc. employed by the prior art to reduce friction can be used to increase the life of the mold according to the invention and to improve the quality of the strand surface.

For better perception, each of the figures shows a straight tube mold. However, the invention is also applicable to curved molds, as well as bloom molds, plate molds, etc.

An exemplary embodiment of a method according to the invention for making the molds of the invention with either curved or straight mold cavities is outlined below.

An extruded tube of copper or a copper alloy is bent to the casting radius of a curved-mold continuous casting apparatus by means of a curved mandrel. The bending operation, which is omitted for straight molds, is performed using conventional techniques. Following the bending operation, an expanding mandrel is inserted in the tube. For straight molds, the expanding mandrel is inserted in the unbent tube. The tube is then expanded over its entire length, or over a portion of its length, using movable expanding components having configurations which correspond to those of the desired protuberances. When the tube is made of a hardenable copper alloy, the tube is subsequently dispersion hardened or hardened by cold working, e.g., shot peening.

By additionally calibrating the tube on a mandrel over its entire length, or over part of its length, using an explosion forming technique, a tube mold having a mold cavity of high precision can be obtained.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Mold for the continuous casting of metals, comprising wall means defining a casting passage having a periphery, a longitudinal axis, an open inlet end for molten metal and an open outlet end for a continuously cast strand of the metal, said ends being spaced from one another axially of said passage, and said passage including a portion in which said periphery comprises a plurality of first sections circumferentially of said passage, said portion extending axially from said inlet end towards said outlet end, and said first sections being located in the region of said inlet end and abutting one another along axially extending boundaries, each of said first sections having a corresponding second section at said outlet end, and each of said first sections defining a cross-sectional enlargement of said passage, relative to the corresponding second section, in the form of a bulge, each of said bulges having a depth which decreases in a direction from said inlet end towards said outlet end such that the strand is shaped during travel through said axially extending portion of said passage, and each of said bulges extending from one boundary of the respective first section to the other.

2. The mold of claim 1, wherein said bulges have substantially identical shapes and sizes.

3. The mold of claim 1, wherein said bulges have central portions and circumferential end portions, said end portions having a taper between 0 and 1 percent per meter and said central portions having a taper between about 10 and about 35 percent per meter.

4. The mold of claim 1, wherein said passage is generally polygonal and has a plurality of corners, said first sections abutting one another at said corners.

5. The mold of claim 4, wherein said passage is generally quadrangular or hexagonal.

6. The mold of claim 1, wherein said passage is generally circular, said sections having substantially the same size and numbering at least 3.

7. The mold of claim 1, wherein said passage has the configuration of a preform at said outlet end.

8. The mold of claim 7, wherein said passage is substantially I-shaped at said outlet end.

9. The mold of claim 1, each of said sections defines a substantially part-circular bulge.

10. The mold of claim 1, wherein said axially extending portion of said passage constitutes a first portion of said passage, said passage including an axially extending second portion in which said periphery comprises a plurality of additional sections circumferentially of said passage, and each of said additional sections having a corresponding further section at said outlet end, each of said additional sections defining an additional cross-sectional enlargement of said passage, relative to the corresponding further section, in the form of an additional bulge, and each of said additional bulges having a depth which decreases in a direction from aid inlet end towards said outlet end such that the strand is shaped during travel through said second portion, said first sections being circumferentially offset with respect to said additional sections.

11. The mold of claim 10, wherein said first and additional sections have a predetermined circumferential length and said first sections are circumferentially offset with respect to said additional sections by one-half of said predetermined circumferential length.

12. The mold of claim 1, wherein each of two of said bulges has a radially outermost location at said inlet end, said radially outermost locations being diametrically opposed, and each of said radially outermost locations being in axial alignment with a respective peripheral location at said outlet end, said passage having a first width at said inlet end equal to the distance between said radially outermost locations and a second width at said outlet end equal to the distance between said peripheral locations, and said first width being about 5 to about 15 percent greater than said second width.

13. The mold of claim 12, wherein said first width is at least 8 percent greater than said second width.

14. The mold of claim 1, wherein said passage has a predetermined length and said axially extending portion of said passage has a length equal to at least 50 percent of said predetermined length.

15. The mold of claim 1, wherein said passage has a diagonal plane and said axially extending portion of said passage has an axial taper in said diagonal plane between 0 and about 1 percent per meter.

16. The mold of claim 15, wherein said axial taper is between about 0.1 and about 0.5 percent per meter.

17. The mold of claim 1, wherein said passage has a pair of neighboring corners which are spaced from one another by a predetermined distance in a plane transverse to said longitudinal axis, at least one of said corners being rounded and having a radius in said plane which equals between about 3 and about 8 percent of said predetermined distance.

18. The mold of claim 1, wherein said bulges are bounded by arcuate surfaces, plane surfaces or both arcuate and plane surfaces.

19. The mold of claim 1, wherein at least one of said boundaries has an axial taper derived from a calculated circumference of the strand and a calculated shrinkage of the strand transverse to said axis.

* * * * *